US009713201B2

(12) United States Patent
Merkent

(10) Patent No.: US 9,713,201 B2
(45) Date of Patent: Jul. 18, 2017

(54) COUNTER TOP WASHCLOTH STEAMER

(71) Applicant: William H. Merkent, Staten Island, NY (US)

(72) Inventor: William H. Merkent, Staten Island, NY (US)

( * ) Notice: Subject to any disclaimer, the term of this patent is extended or adjusted under 35 U.S.C. 154(b) by 0 days.

(21) Appl. No.: 15/150,539

(22) Filed: May 10, 2016

(65) Prior Publication Data

US 2016/0255679 A1 Sep. 1, 2016

Related U.S. Application Data

(63) Continuation-in-part of application No. 14/261,050, filed on Apr. 24, 2014, now abandoned.

(51) Int. Cl.

| | |
|---|---|
| ***D06B 1/08*** | (2006.01) |
| ***D06B 5/24*** | (2006.01) |
| ***D06C 7/00*** | (2006.01) |
| ***H05B 1/02*** | (2006.01) |
| ***H05B 3/24*** | (2006.01) |

(52) U.S. Cl.

CPC ..... *H05B 1/0272* (2013.01); *D06B 1/08* (2013.01); *D06B 5/24* (2013.01); *D06C 7/00* (2013.01); *H05B 3/24* (2013.01)

(58) Field of Classification Search

CPC ... D06B 1/08; D06B 5/24; D06C 7/00; H05B 1/0272; H05B 3/24

USPC ..... 8/149.3; 219/524

See application file for complete search history.

(56) References Cited

U.S. PATENT DOCUMENTS

| | | | | |
|---|---|---|---|---|
| 7,161,120 | B1 * | 1/2007 | Stroud | A45C 13/28 219/386 |
| 2010/0024243 | A1 * | 2/2010 | Ricklefs | D06F 58/203 34/474 |

* cited by examiner

*Primary Examiner* — Michael Barr
*Assistant Examiner* — Levon J Shahinian
(74) *Attorney, Agent, or Firm* — Michael J. Feigin, Esq.; Feigin & Fridman

(57) ABSTRACT

A washcloth steamer is designed as a counter top device for a consumer to effectively and efficiently heat a single, wetted washcloth to a temperature of between 150 and 212 degrees Fahrenheit. The washcloth steamer is formed with a bowl-type housing containing a heating plate therein. The wetted washcloth is provided around or about upper and lower surfaces of the heating plate. When the clamshell type housing is closed about the heating plate and wetted washcloth, the heating plate is activated to heat the wetted washcloth for a predetermined or until the washcloth or the heating plate reach a maximum temperature. Because the heating plate is configured to quickly heat the washcloth and water, a moisture sensor is included that is relied upon to deactivate the heating plate if the detected moisture is too low, to avoid singeing or igniting the washcloth.

9 Claims, 3 Drawing Sheets

COUNTER TOP WASHCLOTH STEAMER

CROSS-REFERENCE TO A RELATED APPLICATION

This application is a continuation-in-part (CIP) application of U.S. patent application Ser. No. 14/261,050, filed Apr. 24, 2014 ("the parent application"); this CIP application claims priority from the parent application under 35 USC §120, the contents of which parent application are incorporated by reference herein.

BACKGROUND OF THE INVENTION

The present invention relates to steamers and, more particularly, to a personal, counter top washcloth steamer that is configured to provide a steaming hot washcloth to a user.

The invention provides the convenience of a rapidly steamed washcloth to the end consumer through a compact device with an easy and intuitive user interface. Apart from the refreshing feeling one obtains through the application of a steamed washcloth, the novel device has additional uses. Facial pores are closed and need to be opened in order to receive medicinal treatments, for example. One way to achieve this goal is to steam a washcloth that can be applied to the face.

Conventional washcloth steamers, however, are large, commercial devices and are not designed for the individual consumer. Moreover, these conventional washcloth steamers are too large to fit on a consumer's bathroom counter, requiring the user to find an appropriate area to store and place when desired for use. These conventional washcloth steamers are designed for steaming multiple washcloths at once and, therefore, do not meet a consumer's single use expectation.

For example, U.S. Pat. No. 7,161,120 to Stroud discloses a garment warming, as opposed to steaming, system and device that provides an electrically-heated insulated water-resistant and weather-resistant clothing warmer with a clamshell design that warms, clothing, robes, slippers, towels, blankets. The Abstract states that the Stroud device comprises a liquid tight seal preventing moisture from entering the device and the Summary states that an object of the Stroud invention is to provide a device to keep robes, towels, slippers, blankets and other cloth-like materials warm and dry while one uses a hot tub during cold or wet weather.

The overall intent in Stroud is to keep a garment "warm and dry." To that end, Stroud relies on dry heat as opposed to steam heat. This is clear throughout the Stroud disclosure in their reference to "desiccation" (e.g., col. 1, lines 35-36 and 60-63), which a state of "extreme dryness" or the "process of extreme drying." In this regard, Stroud specifically states its Garment Warming System is focused upon and otherwise "concerned with desiccation" and that the intended purpose of the Stroud device is to "keep robes, towels, slippers, blankets and other cloth like materials warm and dry." (column 1, lines 35-36 and lines 60-63). Stroud goes on to state that "the user may enjoy himself or herself knowing that the device's insulation and optional internal battery powered heating element(s) will ensure their clothes are warmed, and said seal 3 will keep their clothes dry" (column 8, lines 51-55) and mentioning that one of the device's intended objectives is "ensuring warm and dry clothing and towels await the user once the user is done enjoying him or herself in the spa or hot tub" (column 8, line 66 to column 9, line 1).

SUMMARY OF THE INVENTION

The present invention overcomes the shortcomings of known arts, such as those mentioned above.

As compared with Stroud in particular, the inventive counter top washcloth steamer works through the use of water in a moistened washcloth. In that regard, the Counter Top Washcloth Steamer requires the water in a pre-moistened washcloth to act as a heat transfer agent, which when heated by the heating element, generates steam heat in the device. It is precisely this steam heat that is utilized to reach the desired result of a hot wet washcloth. As discussed more fully herein, the use of steam heat also allows the device to heat the washcloth quickly and efficiently. Any reference to water in Stroud is limited to its statements that are concerned with having water unintentionally enter the device. Specifically, Stroud's patent is entirely devoid of any reference to steam and nearly every reference to water deals with the concepts of water-resistance, waterproofing or water damage.

Stroud at column 4, line 8-18 states that "Because the warmed garment is likely to be used near water or in wet weather, the garment warmer must be water resistant to protect the electrical components therein. Seal 3, positioned between the outside elements and the internal elements of the device helps insulate the inside of the device from the external environment. While the seal 3 is primarily for retaining heat within the device, it also serves as a barrier to external liquids, aiding in the overall water-resistance of the device. As the upper lid 1 and lower lid 2 are moved to a closed position about said hinge, said seal 3 is compressed by the joining surfaces of said lids." (emphasis added).

Stroud at col. 6, lines 22-26 explains that a cloth or fabric made of natural or artificial fibers and having a thermal conductivity of less that 0.2 $W*m^{-1}$ $K^{-1}$ at a temperature between 0 and 100 degrees Fahrenheit is preferred. Stroud's heating element pad 61, therefore, cannot be said to be configured to receive a single, moistened washcloth thereabout to heat to temperatures approaching the water boiling point.

There is no disclosure of placing a single, moistened wash cloth about a heating plate disposed between the lid housing and the base housing so that a portion of the single, moistened washcloth is disposed between a top surface of the heating plate and the lid housing and another portion of the single, moistened washcloth is disposed between a bottom surface of the heating plate and base housing.

The invention provides a washcloth steamer designed as a counter top device for a consumer to effectively and efficiently heat a single, wetted washcloth to a washcloth temperature of between 150 and 212 degrees Fahrenheit, and method implemented using same. The washcloth steamer is formed with a clamshell type housing containing a heating plate therein. The wetted washcloth is provided around or about upper and lower surfaces of the heating plate. When the clamshell type housing is closed about the heating plate and wetted washcloth, the heating plate is activated to heat the wetted washcloth for a predetermined or until the washcloth or the heating plate reach a maximum temperature. Because of the heating plate is configured to quickly heat the washcloth and water, a moisture sensor is included that is relied upon to deactivate the heating plate if the detected moisture is too low, to avoid singeing or igniting the washcloth.

In one embodiment, the invention provides a washcloth steamer comprising a base housing; a lid housing pivotably opening from the base housing; a heating plate disposed in a region formed between the base housing and the lid housing; and an on-off switch operable to deliver power to the heating plate to warm the heating plate to a predetermined temperature for a predetermined period of time, wherein the heating plate is configured to receive a washcloth thereabout and where heating the heating plate heats the washcloth.

In a method embodiment, the invention provides for steaming or heating a washcloth using a washcloth steamer. The user first wets the washcloth and then opens a lid housing of the washcloth steamer that is pivotably connected to a base housing of a washcloth steamer, places the washcloth about a heating plate disposed between the lid housing and the base housing, closes the lid housing onto the base housing, sandwiching the washcloth and heating plate therebetween and activates a power supply to the heating plate to warm the heating plate to heat the heating plate a predetermined temperature for a predetermined period of time, or to heat the heating plate until the temperature of the wetted washcloth reaches a maximum.

In another embodiment, the invention provides a washcloth steamer designed for counter top use for heating a single, wetted washcloth. The washcloth steamer comprises a base housing, a lid housing pivotably opening from the base housing, a heating plate disposed in a region formed between the base housing and the lid housing and configured to receive a single, wetted washcloth thereabout, and an on-off switch operable to deliver power to the heating plate to heat the heating plate to a predetermined temperature for a predetermined period of time, and deliver heat to the wetted washcloth. The region in which the heating plate is disposed is dimensioned to receive a portion of the single, wetted washcloth between a top surface of the heating plate and the lid housing and another portion of the single, wetted washcloth between a bottom surface of the heating plate and the base housing, such that the single, wetted washcloth and heating plate are sandwiched between the lid housing and the base housing when closed.

The washcloth steamer may further comprise a first indicator light illuminating while the washcloth steamer is in operation over the predetermined period of time; and a second indicator light illuminating when the predetermined period of time is passed and the wetted washcloth is ready for use. The washcloth steamer may further comprise a lift tab disposed on a portion of the lid housing opposite where the lid hosing pivots from the base housing, a plurality of legs supporting the base housing and a hinge disposed to pivotably connect to the lid housing with the base housing. A control unit controls the predetermined period of time. A temperature sensor arranged proximate the heating plate and electrically connected to the control unit may also be included. The control unit maintains the heating plate in an active heating state for the predetermined period of time or until a temperature detected by the temperature sensor reaches a pre-determined power cutoff temperature. A moisture sensor arranged proximate the heating plate and electrically connected to the control unit also may be included. In that case, the control unit maintains the heating plate in an active heating state for the predetermined period of time or until a temperature detected by the moisture sensor detects that a moisture content of the wetted washcloth reached a pre-determined power cutoff moisture.

The invention also provides a method of heating a single washcloth using a washcloth steamer. The method includes wetting the single washcloth with water, opening a lid housing that is pivotably connected to a base housing of the washcloth steamer, placing a single, wetted washcloth about a heating plate disposed between the lid housing and the base housing so that a portion of the single, wetted washcloth is disposed between a top surface of the heating plate and the lid housing and another portion of the single, wetted washcloth is disposed between a bottom surface of the heating plate and base housing, closing the lid housing onto the base housing, sandwiching the single, wetted washcloth about the upper and lower surfaces of the heating plate between the lid housing and the base housing, activating a power supply to the heating plate to heat the heating plate for a predetermined period of time in order to transfer heat from the heating plate to the single, wetted washcloth and deactivating the power supply to the heating plate prior to an end of the predetermined period of time if a temperature of the wetted washcloth being heated exceeds a predetermined maximum temperature.

The step of deactivating further may further include deactivating the power supply to the heating plate prior to the end of the predetermined period of time if a moisture content of the wetted washcloth being heated, or proximate the wetted washcloth being heated drops below a predetermined minimum moisture content. The step of deactivating may further include deactivating the power supply to the heating plate prior to the end of the predetermined period of time if a temperature of the wetted washcloth being heated, or proximate the wetted washcloth being heated, exceeds a predetermined maximum temperature. The step of deactivating may further include deactivating the power supply to the heating plate prior to the end of the predetermined period of time if a temperature of the heating plate exceeds a predetermined maximum heating plate temperature.

The method may further comprise illuminating a first indicator light while the washcloth steamer is in operation over the predetermined period of time, and/or illuminating a second indicator light when the predetermined period of time is passed and the wetted washcloth is ready for use. Preferably an alarm signal is communicated to a user if the temperature of the heating plate exceeds the predetermined maximum heating plate temperature, where the alarm signal includes blinking a first indicator light, a second indicator light or both. The predetermined period of time in which the power supply actively supplies power to the heating plate is one minute.

These and other features, aspects and advantages of the present invention will become better understood with reference to the following drawings, description and claims.

BRIEF DESCRIPTION OF THE DRAWINGS

Further details, features, objectives, and advantages of the present invention are explained in greater detail in the following on the basis of the drawing of a preferred exemplary embodiment. In the drawings.

DETAILED DESCRIPTION OF THE PREFERRED EMBODIMENTS

Figure 1:
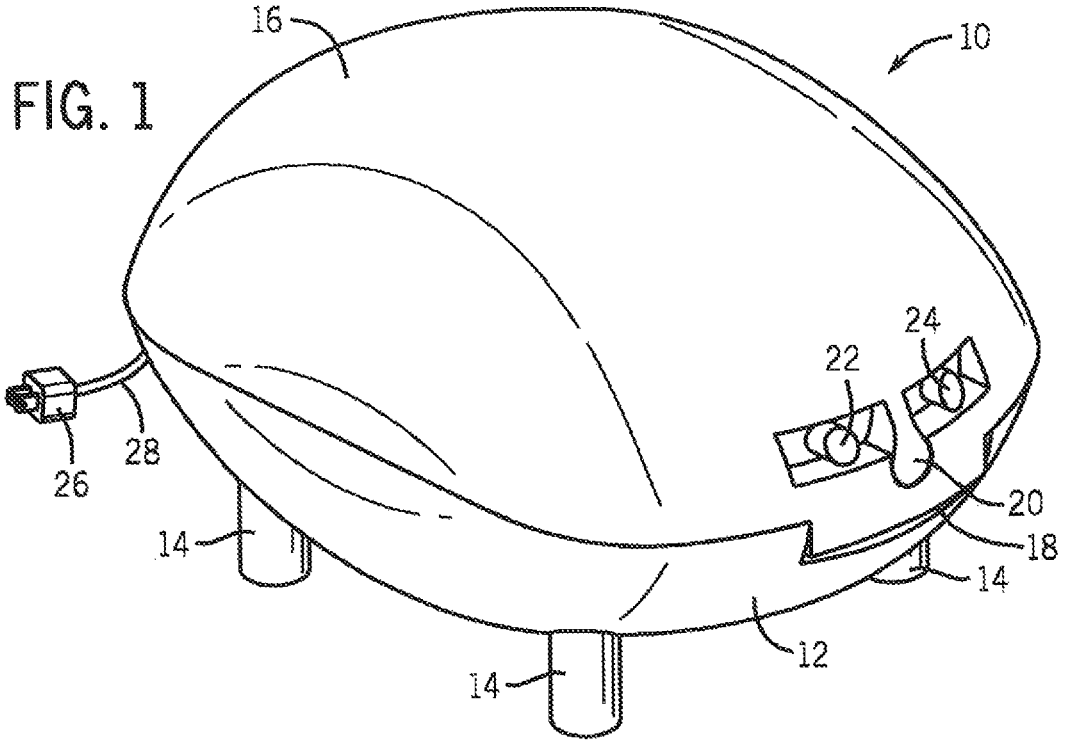
FIG. 1 is a perspective view of a washcloth steamer according to an exemplary embodiment of the present invention.
Figure 2:
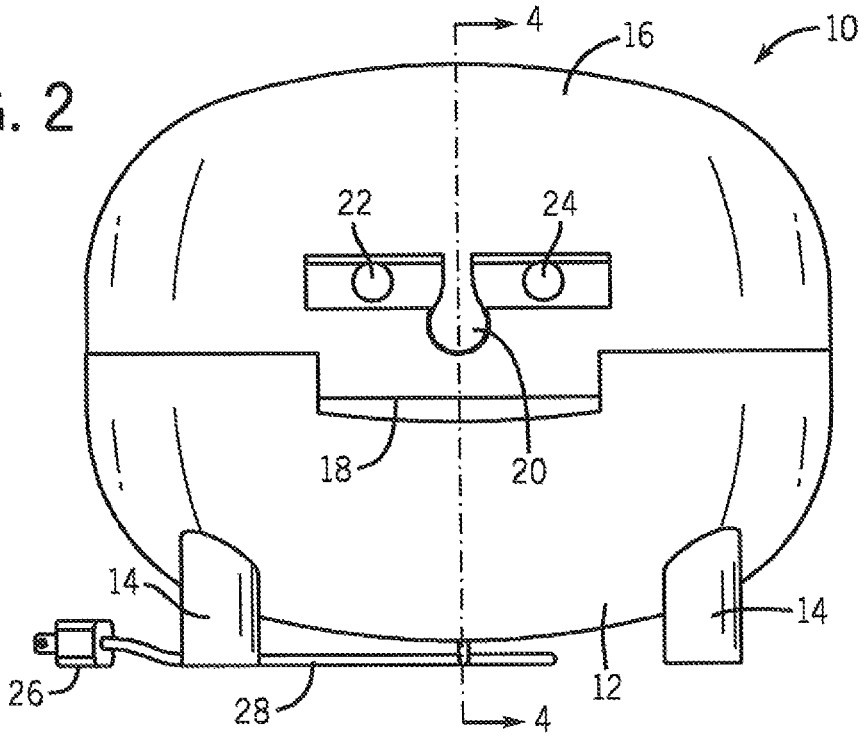
FIG. 2 is a front view of the washcloth steamer of FIG. 1.

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Broadly, an embodiment of the present invention provides a washcloth steamer that is designed as a counter top device for a consumer to effectively steam a single washcloth in a short amount of time. The washcloth steamer can include a clamshell type housing containing a heating plate therein. The heating plate receives a damp but preferably wet washcloth, preferably arranged to surround both the upper and lower surfaces of the heating plate and, when the bowl-type housing is closed, the heating plate heats or steams the washcloth and water mass contained therein to a predetermined (i.e., preset) temperature.

As the amount of time required to heat a wetted washcloth to a predetermined temperature is dependent on the starting temperature and the mass of the washcloth material and water, and the operating temperature of the heating element in the heating plate, the time required for heating, i.e., steaming, is in exact. The inventive washcloth steamer, however, may be set to heat or steam for a predetermined amount of time rather than to a predetermined temperature. An indicator light on an exterior of the washcloth steamer can alert the user when the washcloth is ready for use, i.e., has been heated to a desired temperature, or has been heated for a predetermined time. Preferably, the heater is able to heat a conventional washcloth (e.g., a cotton facecloth that is 8"×8" or 8"×10", without limitation) that is wetted to contain at least 2 ounces of water, preferably 4 ounces of water.

As used as a verb herein, "steam" is meant to define the function of heating a water-moistened washcloth (sometimes referred to as a facecloth), by the inventive washcloth steamer, so that the washcloth and several ounces of water contained therein are preferably heated to a temperature in a range between 140 and 212 degrees Fahrenheit. Preferably, the washcloth and water contained therein is heated or steamed to about 180 degrees Fahrenheit, so that a "steamed" washcloth, while hot and wet, is not hot enough to cause burns if immediately applied to a face of a user. The washcloth steamer may heat (i.e., activate the heating by the heating plate or element therein) a wetted washcloth for a predetermined time or for a time required to heat the washcloth/water to a predetermined temperature. To do so, the washcloth steamer includes a timing mechanism, for example, which allows the heating element to apply heat for a predetermined time only.

The washcloth steamer also includes a thermostat and a control device able to set a temperature to which the washcloth and water contained therein will be heated by the activated heating plate, where the heating plate is deactivated by the controller when the temperature sensed by the temperature sensor is determined by the control device to reach the preset temperature. The washcloth steamer also includes a moisture sensor as a safety feature, which prevents activation of the heating plate (or deactivates the heating plate) if there is insufficient moisture detected proximate the heating plate, i.e., in the wetted washcloth. This is required in the invention because the heating plate may itself operate at temperatures in excess of the boiling point of water to heat the wetted washcloth quickly, so without a minimum water content or moisture in the washcloth, the cloth material could be singed. The temperate sensor and safety cutoff prevents the temperature of the heating plate from exceeding 240 degrees Fahrenheit, so that even if the water content drops below a minimum, the temperature will not exceed 240 degrees Fahrenheit and avoid combusting the washcloth fabric is dry.

Referring now to FIGS. 1 through 4, a washcloth steamer 10 can include a base housing 12 and a lid housing 16. The base housing 12 may rest on a surface during use or, in some embodiments, as shown in the Figures, may be supported by a plurality of legs 14 extending from a bottom surface of the base housing 12.

Figure 3:
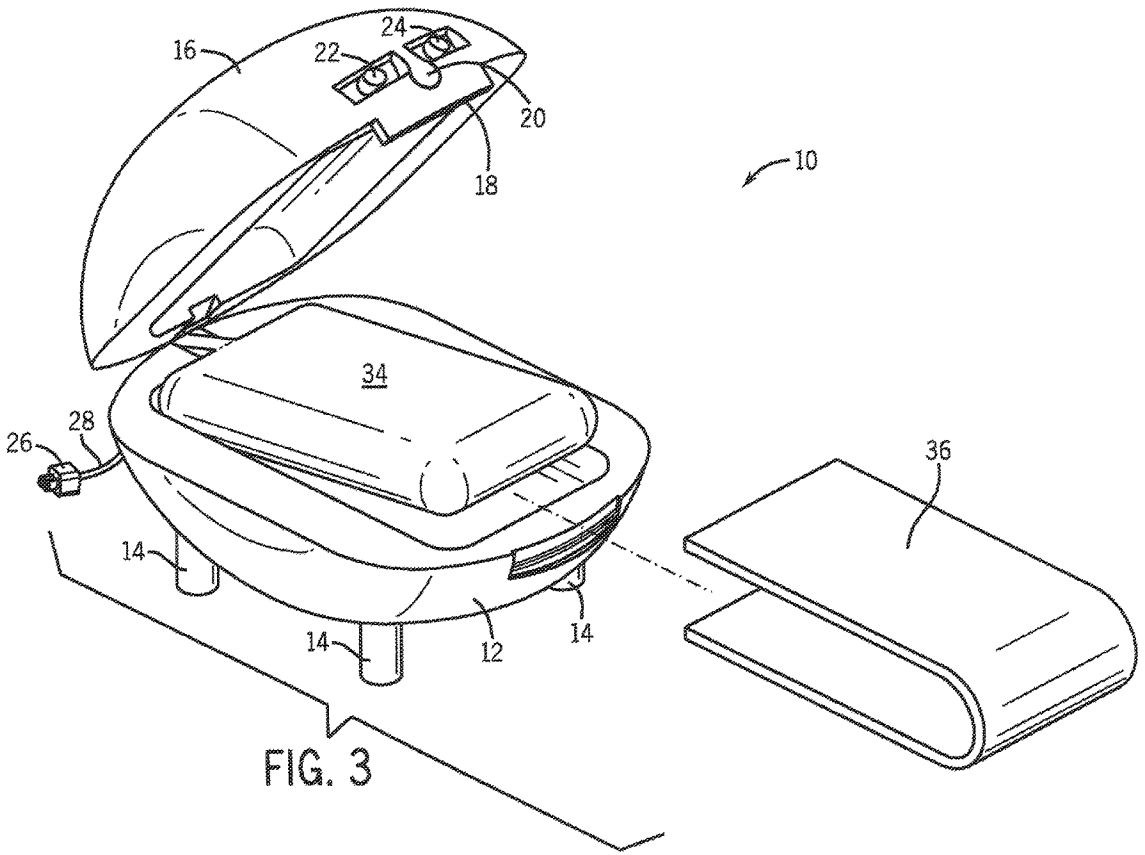
FIG. 3 is a perspective view of the washcloth steamer of FIG. 1, in an open configuration, illustrating the placement of a washcloth in the washcloth steamer.

The lid housing 16 may be connected at one side thereof with a pivoting connection, such as a hinge 30, for example. This configuration allows the lid housing 16 to be moved between a closed configuration (FIG. 1) and an open configuration (FIG. 3). A lift tab 18 can be provided on the lid housing 16 to provide a location for a user to contact to help left the lid housing 16 into the open configuration. In some embodiments, the lift tab 18 may provide a locking connection to the base housing 12, assuring that the lid housing 16 is secured to the base housing 12 during use of the washcloth steamer 10.

A heating plate 34 may disposed inside the lid housing 16 and the base housing 12 when in the closed configuration. The heating plate 34 can heat to a desired temperature during operation of the washcloth steamer 10. That is, the heating plate may be heated to a temperature of about 240 degrees Fahrenheit, which will efficiently and quickly transfer heat to the water contained in the wetted washcloth. Alternatively, the temperature of the wetted washcloth itself is monitored to a desired washcloth temperature. This available washcloth temperature range is from about 140 to about 212 degrees Fahrenheit, but will typically be set to between 165 and 190 degrees Fahrenheit. Preferably, however, the temperature is set so that the washcloth and water therein is heated to 180 degrees Fahrenheit, to avoid burning the user.

Figure 4:
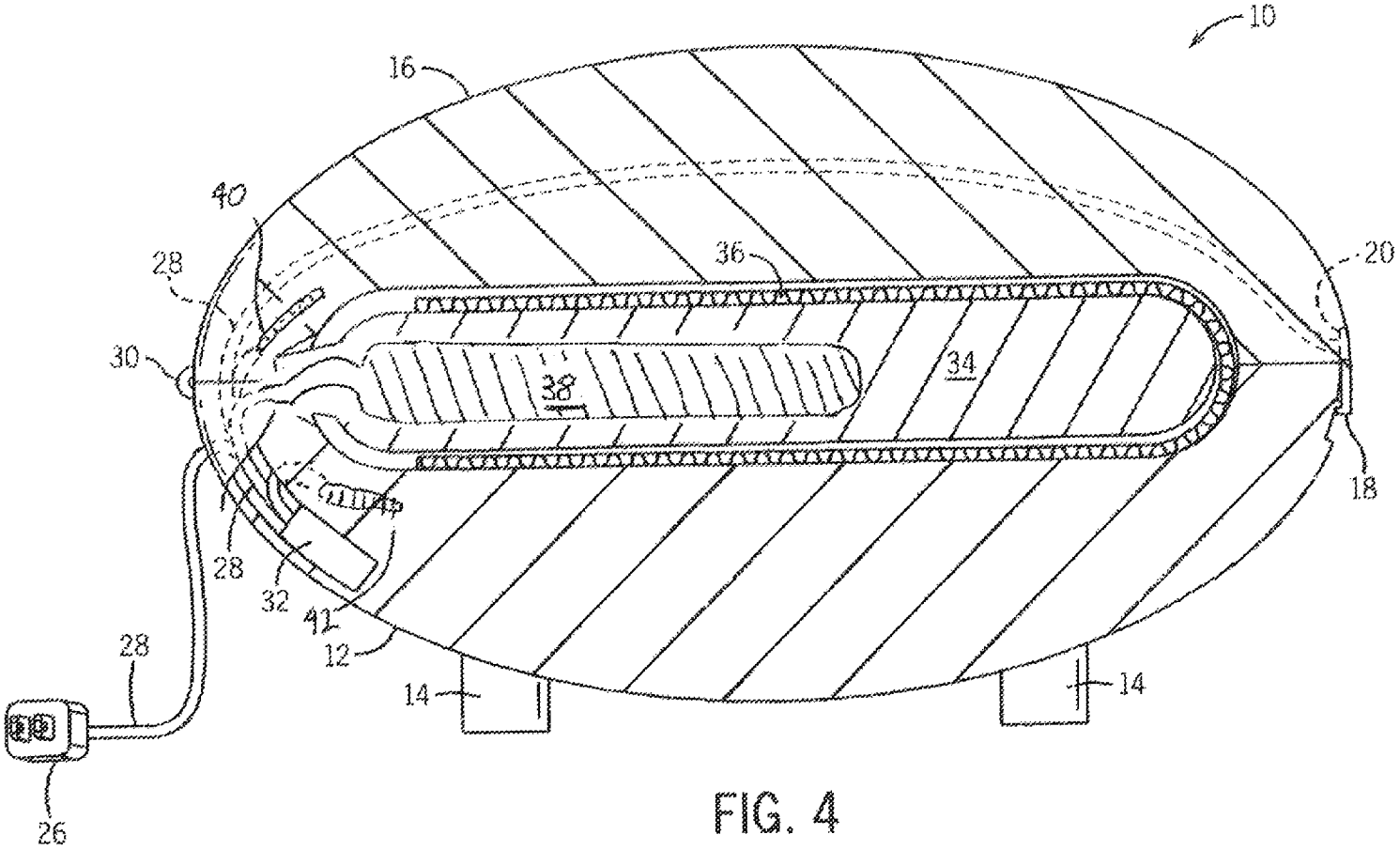
FIG. 4 is a cross-sectional view taken along line 4-4 of FIG. 2, illustrating the placement of a washcloth in the washcloth steamer when in a closed configuration.

The heating plate 34 may fit within the lid housing 16 and the base housing 12 with space for the washcloth 36 when the washcloth steamer 10 is in the closed configuration (FIG. 4). The heating plate 34 may be formed in a shape to receive a washcloth 36 about at least a portion of the exterior surface thereof, top and bottom surfaces thereof as shown. The heating plate 34, however, may take various shapes and sizes, depending on the particular application, without deviating from the scope and spirit of the invention. Preferably, the lid housing 16 and the base housing 12 are designed in a bowl-type shape to provide the interior compartment for the heating plate 34 and the washcloth 36.

The heating plate 34 may pivotably connect to at least one of the base housing 12 and the lid housing 16. Typically, the heating plate 34 connects to the base housing 12 and the lid housing 16 at the location where these members pivot. In some embodiments, as the lid housing 16 is lifted, the heating plate 34 can automatically raise to provide a region to insert the washcloth 36, as shown in FIG. 3. In other embodiments, the heating plate 34 may independently pivot within the lid housing 16 and the base housing 12.

The heating plate 34 may be powered by electrical power delivered by an electric cord 28 having a plug 26 on one end thereof. In some embodiments, the heating plate may be powered by alternate sources, such as by batteries, or the like.

An on-off switch 20 may be disposed on the washcloth steamer 10. Depression of the on-off switch 20 can cause a first indicator light 22, typically a red indicator light, to illuminate, signifying that the heating plate 34 is warming and providing heat to the washcloth 36. After a predetermined period of time, such as one minute, for example (or a variable period of time, depending on desired temperature), the first indicator light 22 may turn off and a second indicator light 24, such as a green indicator light, can illuminate, signifying that the washcloth 36 has been warmed and is ready to be used as a steamed washcloth. In some embodiments, the on-off switch 26 may be designed to automatically turn on when the lid housing 16 is closed and power is supplied to the washcloth steamer 10.

A control unit 32 can be provided in the washcloth steamer 10 to provide the desired temperature to the heating plate 34, to control the time power is delivered to the heat plate 34, to control the indicator lights 22, 24, and the like. In some embodiments, an adjustment mechanism (not shown), such as a turn dial, a digital display, or the like, may be provided to allow the user to select a desired temperature, within a given temperature range.

The washcloth steamer includes a thermostat 38 and a temperature sensor 40. Preferably, the washcloth steamer includes a moisture sensor 42. The thermostat 38, temperature sensor and the moisture sensor, if included, are positioned inside the washcloth steamer proximate to the heating plate 34 and connected electrically to the control unit 34. The thermostat allows for setting a temperature to which the washcloth and water contained in the washcloth are heated. The temperature sensor senses the temperature of the wetted washcloth. The moisture sensor senses the amount of moisture (i.e., water) in the wetted washcloth.

By including the thermostat 38, temperature sensor 40 and moisture sensor 42, the heating plate 34 is safely controlled based on the detected temperature of the wetted washcloth 36 being heated therein, the moisture content of the washcloth being heated therein or both. For example, while the thermostat 38 sets the desired temperature, the temperature sensor can act as a fail safe by detecting a temperature that exceeds an expected temperature and generating a signal monitored by the control unit, so that the control unit can take action if the set temperature is exceed, for example, interrupting the power to the heating plate or communicating an alarm signal. Likewise, if a moisture sensor is included, the moisture sensor can sense the moisture content of the washcloth, which is reflected in a signal monitored by the control unit. If the moisture content drops below a set minimum, the control unit can take appropriate action, for example, interrupting the power to the heating plate or communicating an alarm signal.

The washcloth steamer 10 can be made from various materials. In view of the fact that the washcloth steamer is intended to be used with wetted washcloths, at temperatures likely to cause water to transition to steam, the materials selected will be unaffected by moisture, as the inside of the lid housing 16, the inside of the base housing 12 and the heating element 34 are in contact with a warm, wet washcloth, often generating steam. That is, the heating plate 34 is configured to operate at temperatures exceeding 212 degrees Fahrenheit to transfer heat to the water contained in a wetted washcloth quickly, so must able to withstand water heated to relatively high temperatures. For example, the heating plate 34 is configured to contact and change the temperature of a 3 or 4 ounce mass of material and water (the wetted washcloth) from around 40 or 50 degrees Fahrenheit to around 180 degrees Fahrenheit in 30 to 120 seconds, preferably 60 seconds.

While the above outline describes a washcloth steamer for a user to use for themselves, the steamed washcloth provided by the device of the present invention may be used not only for personal use, but also for other uses, such as cleaning surfaces, for example. For that matter, while not limited thereto, the depth (from front to back) and width (from the left side and the right side, and vice versa) of one embodiment of the single washcloth steamer are 7.5 inches and 7.25 inches, respectively; the height is 4.25 inches. The dimensions may be modified without deviating from the scope and spirit of the invention.

It should be understood, of course, that the foregoing relates to exemplary embodiments of the invention and that modifications may be made without departing from the spirit and scope of the invention as set forth in the following claims.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A method of heating a single washcloth using a washcloth steamer, comprising:

wetting the single washcloth with water;

opening a lid housing that is pivotably connected to a base housing of the washcloth steamer;

placing a single, wetted washcloth about a heating plate disposed between the lid housing and the base housing so that a portion of the single, wetted washcloth is disposed between a top surface of the heating plate and the lid housing and another portion of the single, wetted washcloth is disposed between a bottom surface of the heating plate and base housing;

closing the lid housing onto the base housing, sandwiching the single, wetted washcloth about the upper and lower surfaces of the heating plate between the lid housing and the base housing;

activating a power supply to the heating plate to heat the heating plate for a predetermined period of time in order to transfer heat from the heating plate to the single, wetted washcloth;

and deactivating the power supply to the heating plate prior to an end of the predetermined period of time if a temperature of the wetted washcloth being heated exceeds a predetermined maximum temperature.

2. The method of claim 1, wherein the step of deactivating further includes deactivating the power supply to the heating plate prior to the end of the predetermined period of time if a moisture content of the wetted washcloth being heated, or proximate the wetted washcloth being heated drops below a predetermined minimum moisture content.

3. The method of claim 1, wherein the step of deactivating further includes deactivating the power supply to the heating plate prior to the end of the predetermined period of time if a temperature of the wetted washcloth being heated, or proximate the wetted washcloth being heated, exceeds a predetermined maximum temperature.

4. The method of claim 1, wherein the step of deactivating further includes deactivating the power supply to the heating plate prior to the end of the predetermined period of time if a temperature of the heating plate exceeds a predetermined maximum heating plate temperature.

5. The method of claim 4, where an alarm signal is communicated to a user if the temperature of the heating plate exceeds the predetermined maximum heating plate temperature.

6. The method of claim 5, where the alarm signal includes blinking a first indicator light, a second indicator light or both.

7. The method of claim 1, further comprising illuminating a first indicator light while the washcloth steamer is in operation over the predetermined period of time.

8. The method of claim 7, further comprising illuminating a second indicator light when the predetermined period of time is passed and the wetted washcloth is ready for use.

9. The washcloth steamer of claim 1, wherein the predetermined period of time in which the predetermined time of which the power supply actively supplies power to the heating plate is one minute.

* * * * *